US005957451A

United States Patent [19]

Pozzi

[11] Patent Number: 5,957,451

[45] Date of Patent: Sep. 28, 1999

[54] TWO OVERLAPPING LAYER ELEMENT FOR CASH BILL AND PRIZE GAME APPLICATIONS

[76] Inventor: Dario Pozzi, Via Capo Palinuro, 7, 20142 Milan, Italy

[21] Appl. No.: 09/006,016

[22] Filed: Jan. 12, 1998

[30] Foreign Application Priority Data

Jan. 14, 1997 [IT] Italy ..... MI97A0053

[51] Int. Cl.[6] ..... A63F 3/06

[52] U.S. Cl. ..... 273/139; 283/901; 283/903

[58] Field of Search ..... 273/139, 138.1, 273/138.2; 283/94, 100, 101, 103, 106, 901, 903

[56] References Cited

U.S. PATENT DOCUMENTS 3,940,124 2/1976 Johnsen ..... 273/139
4,191,376 3/1980 Goldman et al. ..... 273/139
4,671,512 6/1987 Bachman et al ..... 273/139
4,911,477 3/1990 Shishido ..... 283/100
4,993,714 2/1991 Golightly ..... 273/138.2

*Primary Examiner*—Benjamin H. Layno
*Attorney, Agent, or Firm*—Bucknam and Archer

[57] ABSTRACT

The present invention relates to a two overlapping layer element for cash bill and prize game applications, comprising: a first paper module, specifically designed for a cash bill use; a second paper module specifically designed for a prize game use; and coupling means for coupling the top side edge of the second module to the bottom side edge of the first module overlapped thereon.

The second module is provided with a top surface which comprises a plurality of portions of the winning or not-winning type, which portions can be seen only upon removing the first module.

5 Claims, 3 Drawing Sheets

TWO OVERLAPPING LAYER ELEMENT FOR CASH BILL AND PRIZE GAME APPLICATIONS

BACKGROUND OF THE INVENTION

The present invention relates to a two overlapping layer paper element.

More specifically, the invention relates to a paper element which has been specifically designed for cash bill and prize game applications.

As is known, a prize game associated with products being sold in a supermarket represents an attraction means for the customers susceptible to greatly increase the sales.

Thus, winning indicating systems, such as the insertion in the packages of prize and lottery bills have been devised.

SUMMARY OF THE INVENTION

The aim of the present invention is to overcome a lot of drawbacks associated with prior art prize indicating bills for the above mentioned applications.

A first advantage of the present invention is that it provides a system allowing to detect a possible win in a very short time, like that of the very successfull "instantaneous lottery".

A further advantage of the invention is that it provides a winning detecting system the winning probability of which increases in proportion to the amount of purchases performed by a person, thereby encouraging a person to increase his/her purchases.

Yet a further advantage of the invention is that it provides a prize detecting system which does not interfere against normal selling operations and which, accordingly, can be controlled by conventional controlling procedures of the store or supermarket.

The present invention comprises a paper module or form, on which are indicated possible wins, and on which a conventional cash bill or slip is overlapped.

Thus, a person can detect a possible win in a very short time, the probability of the win increasing with the increase of the number of the products being purchased.

Moreover, the inventive slip does not require any overloads of the conventional store or supermarket operating procedures.

The main object of the present invention is to provide a paper element comprising two overlapping layers, having the above mentioned features, and which can be made in a very simple and unexpensive manner.

In order to achieve the above and other objects, the present invention provides a paper element including two overlapping layers, and being characterized in that it further comprises: a first paper module specifically designed for a cash bill or slip use; a second paper module, specifically designed for a prize game use; as well as coupling means for coupling the top side edge of the second module to the corresponding bottom side edge of the first module overlapped thereon.

According to an embodiment of the present invention, the first module is made in a single piece with the second module and is overlapped thereon, being folded on itself with respect to one of the side edges.

According to the present invention, the second module is provided with a top surface including a plurality of portions of the winning or not-winning type, which can be seen only upon removing the above mentioned overlapping first module.

According to the present invention, the winning portions on the second module are so arranged that the probability of a win is directly proportional to the amount of the performed purchases.

Preferably, according to the present invention, said coupling means comprise a layer of adhesive or semi-adhesive glue, provided at the respective side edges of the first module and second module; according to a modified embodiment, said coupling means can also comprise the side edges of the first module and second module, as suitably glued and die-cut.

BRIEF DESCRIPTION OF THE DRAWINGS

The invention will be disclosed in a more detailed manner hereinafter, by way of a not limitative example of a preferred embodiment thereof, with reference to the figures of the accompanying drawings, where.

DESCRIPTION OF THE PREFERRED EMBODIMENTS

With reference to FIGS. 1 to 6, some preferred embodiments of the two overlapping layer paper element 10 according to the present invention will be disclosed hereinafter.

Figure 1:
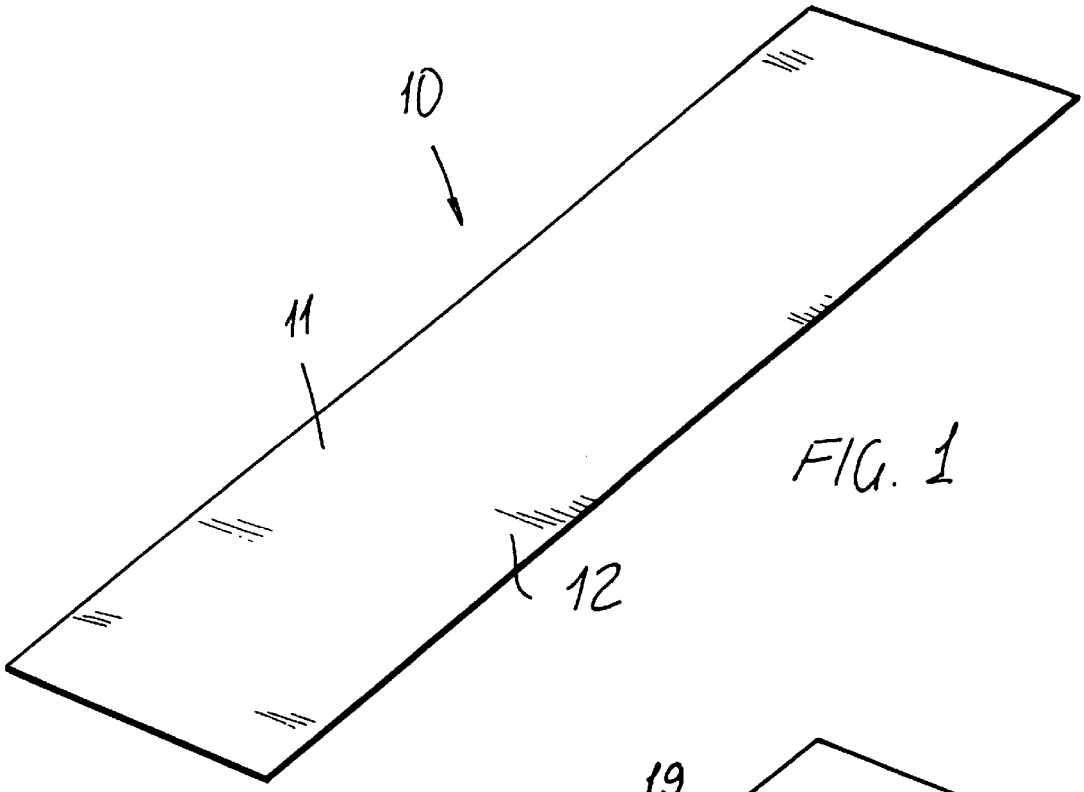
FIG. 1 is a perspective view of a first embodiment of a paper element including two overlapping layers, in which the side edges are coupled by an adhesive or semi-adhesive glue layer.
Figure 2:
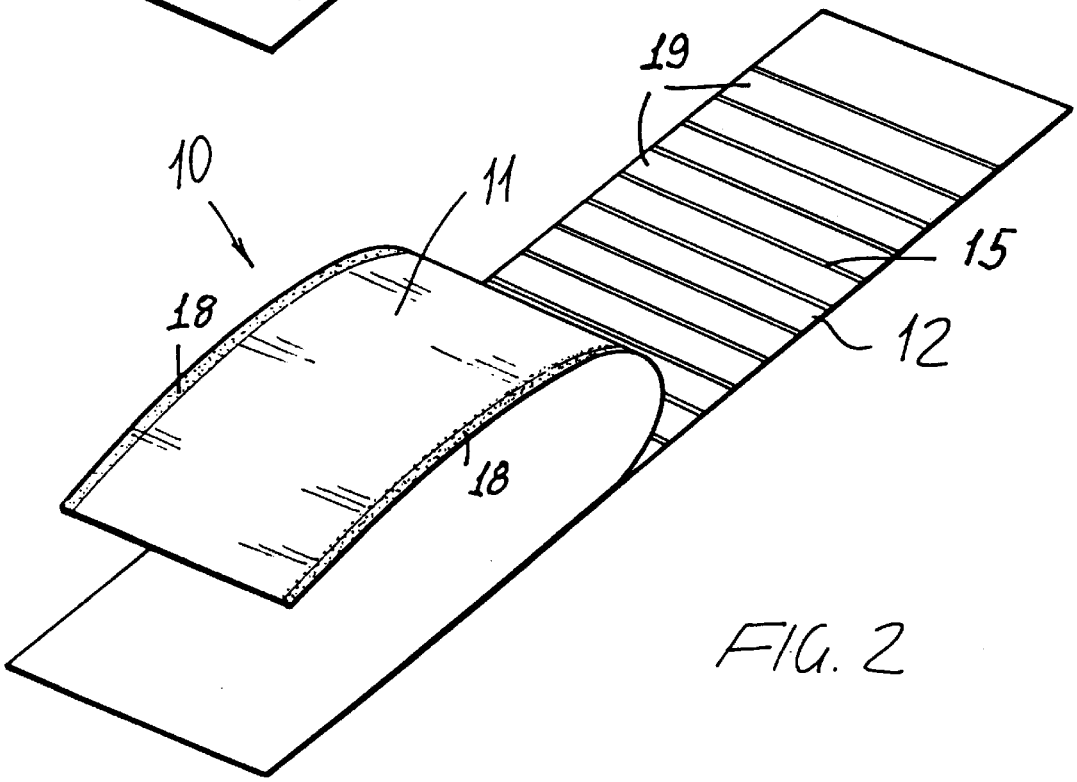
FIG. 2 is a further perspective view of the paper element, shown in FIG. 1, therefrom the top layer has been partially removed.

FIGS. 1 and 2 illustrate a first embodiment, comprising a first paper form or "module" 11 and a second paper form or "module" 12.

The first module 11 is provided with a top surface which is used for printing upon as a conventional cash bill or slip.

Said first module 11 is arranged above the second module 12, specifically designed for a prize game application.

Said second module 12 is provided with a top surface including a plurality of portions or sectors 19, which can be either of a winning or of a not-winning type, and which portions can be separated from one another by partially die-cut lines 15, or they can be glued to one another.

Said surface can be seen only upon removing the overlapping first module 11.

The above mentioned modules 11 and 12 are provided, along their respective side edges 13 and 14, with coupling means, including an adhesive or semi-adhesive glue layer 18.

Figure 3:
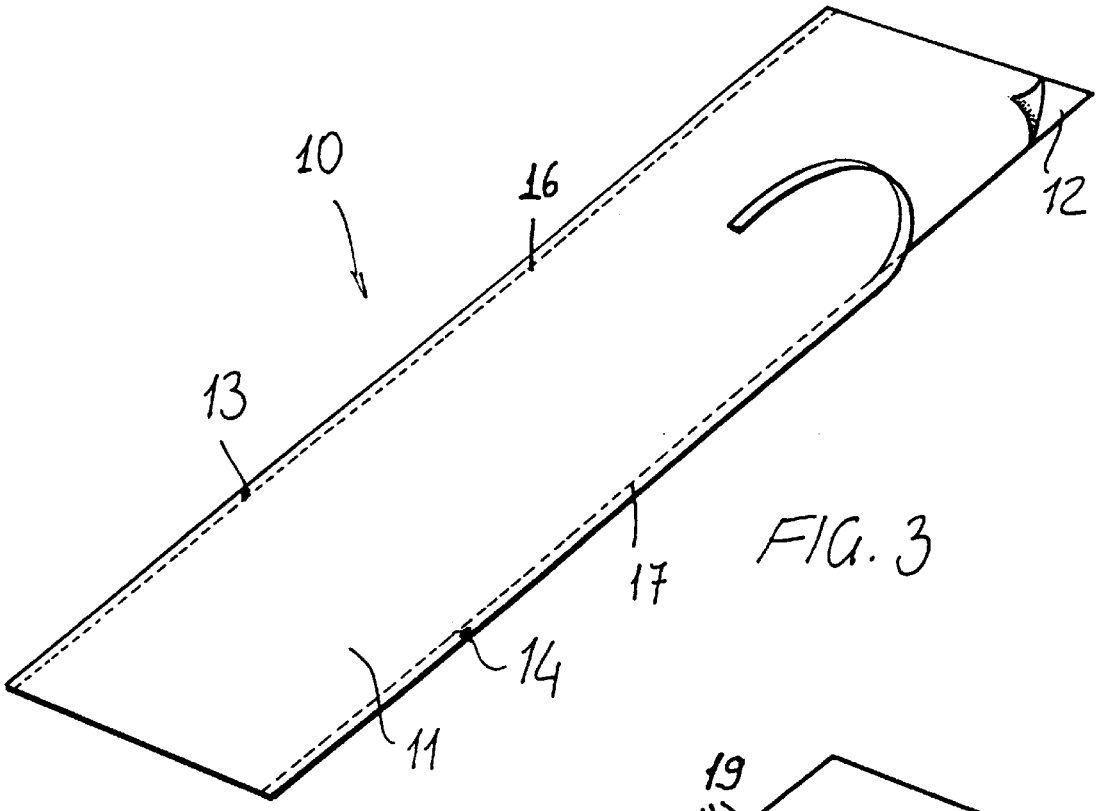
FIG. 3 is a further perspective view of a second embodiment of a two overlapping layer paper element, in which the side edges are coupled by glued side edges provided with suitable die-cut portions.
Figure 4:
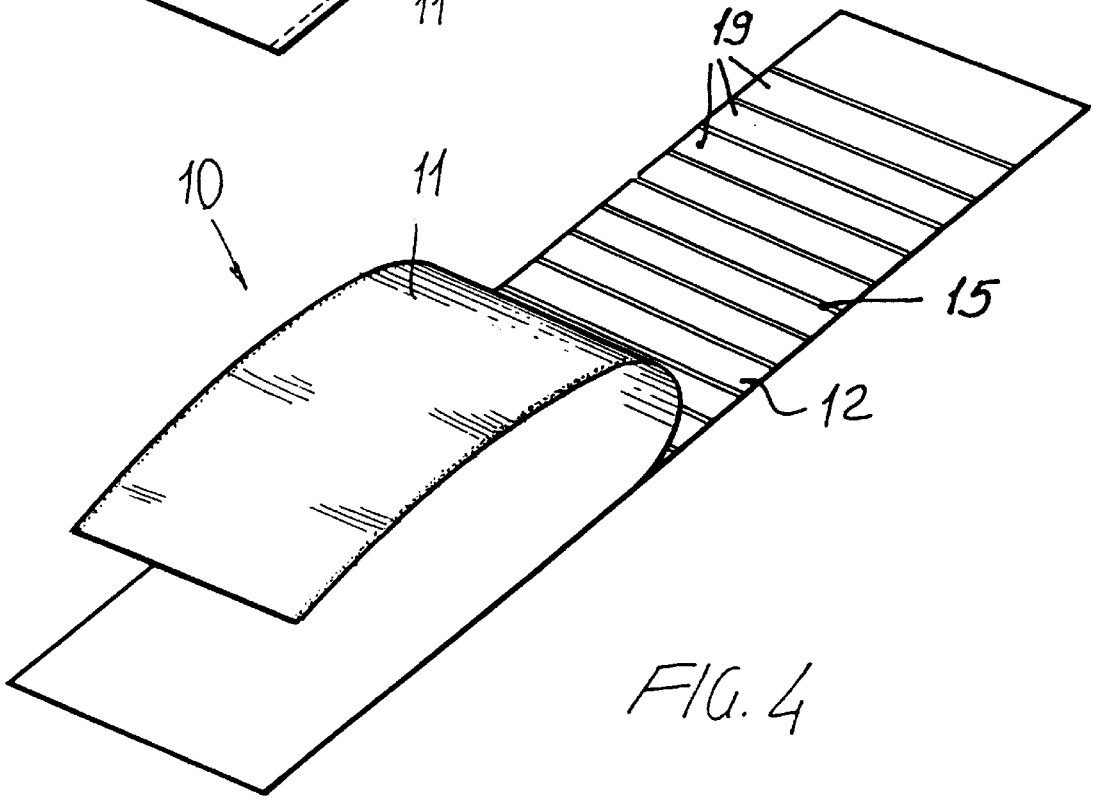
FIG. 4 is a further perspective view of the paper element shown in FIG. 3, therefrom the top layer has been partially removed.

FIGS. 3–4 illustrate a second embodiment of the invention in which said coupling means comprise adhesive side edges 13 and 14 which have been suitably die-cut along the lines 16 and 17.

Figure 5:
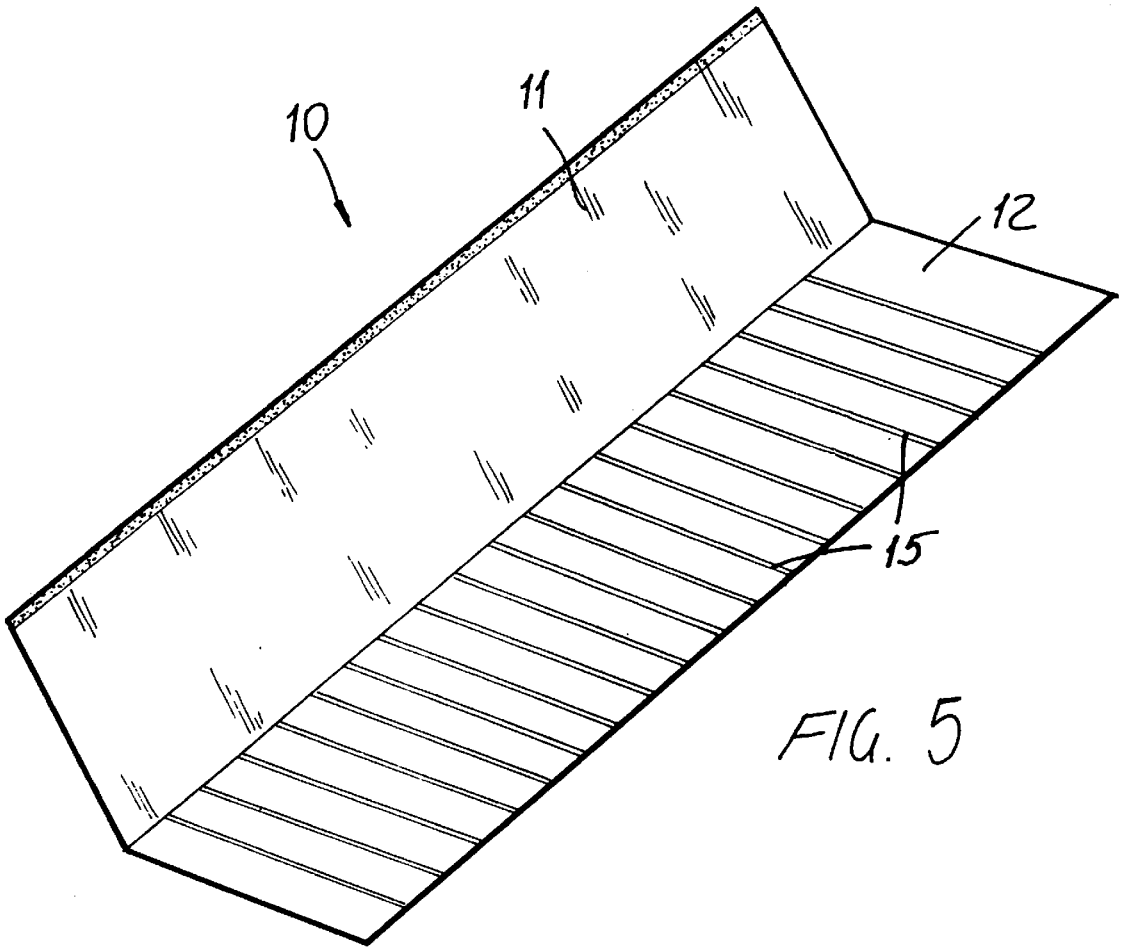
FIG. 5 is a further perspective view of a third embodiment of a two overlapping layer paper element, made as a single piece, with a portion thereof being folded with respect to one of its side edges.

FIG. 5 illustrates a third embodiment of the invention, in which the first module 11 is formed in a single piece with the second module 12 and is arranged above said second module 12 by folding on itself, with respect to one of the above mentioned side edges.

Figure 6:
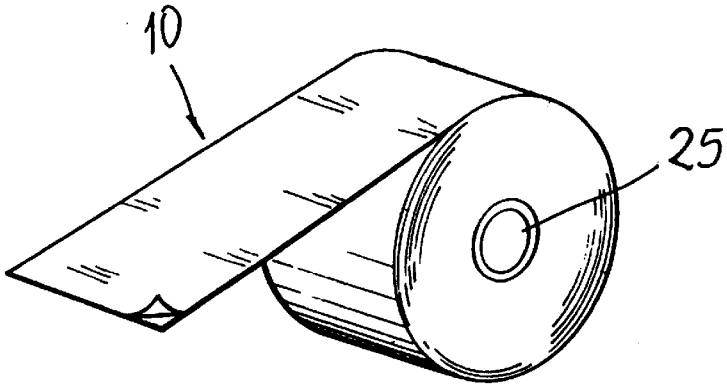
FIG. 6 is a further perspective view of a two overlapping layer paper element, wound about a winding roller.

FIG. 6 clearly shows that the two layer paper element 10 can be easily wound about a winding roller 25, in order to be engaged in a cash register.

A further embodiment of the present invention comprises a first module 11, thereon the cash slip is printed, made of an adhesive paper layer in turn applied to the second module 12 including a siliconized paper support.

In this case too, the overlapping two layer paper element 10 can be wound about a winding roller.

A further embodiment of the invention provides a paper element 10 including a "continuous" or endless form or module provided with entrainment holes formed at the side edges 13 and 14 thereof.

More specifically, the side edges 13 and 14 are coupled to one another by a middle adhesive layer and are provided with longitudinal punching or die-cut lines.

In this case it is not necessary to wind the paper element about a winding roller 25 as shown in FIG. 6, said paper element being folded according to a plurality of overlapping portions, likewise to the endless forms of the computer printers, or said element can also be folded according to any other known methods.

Yet a further embodiment of the present invention provides to print on the first module 11 a single-piece invoice or receipt, of the type used in restaurants or other public stores.

The second module 12, designed for a prize game application, is coupled to the first module 11 by applying an adhesive and die-cutting on the two longitudinal sides of the single-piece invoices, at the longitudinal side edges thereof.

In this case, it would be preferable to seal the paper element even at the cross sides of the invoice, in order to prevent the contents of the second module or prize game information from being exposed to the view.

Finally, it is possible to print information relating to the prize game, and, in particular but not exclusively relating to the prize win, on the rear of the face of the cash slip forming fist module 11.

In this case, the second module 12 can operate as a simple supporting element for the first module 11, in particular for preventing an advance and/or not authorized vision of the contents of the second module or of the information relating to the prize game results.

The second module 12 is coupled to the first module 11 by any of the above disclosed coupling means.

Each of the above disclosed solutions will allow a person to detect in a very short time a possible win, simultaneously with the releasing of the conventional cash slip or, possible, the single-piece invoice or receipt.

The win probability will increase in proportion to the length of the bill and, accordingly, the amount of the performed purchases.

In this connection it should be apparent that the term "prize game" as used in the disclosure and claims is also intended to indicate all the promotional operations such as the so-called point collection operations or the like, as well as any other types of promotional operations related to the selling of consumer products.

To that end, the sectors or portions 19 can also hold, in addition or alternatively to winning or not-winning information, other information, symbols or marks related to specific promotional operations.

Moreover, the present invention can also be used in any commercial activities or supermarkets, without the need of modifying the operating procedure thereof.

While the invention has been disclosed and illustrated with reference to preferred embodiments thereof, it should be apparent that the disclosed embodiments are susceptible to several modifications and variations all of which will come within the scope of the appended claims.

I claim:

1. A two overlapping layer paper element, comprising a roll of a first paper module specifically designed for a cash bill application, a second paper module specifically designed for a prize game application, said first and second module having a top side edge, a bottom side edge and a first and second opposite longitudinal edges, and coupling means for coupling said top side edge of the second module with said bottom side edge of the overlapped first module, said second module having a top surface including a plurality of surface portions, of a winning or a not-winning type, which winning or not winning portions can be seen only upon removing the first overlapping module, said winning portions being distributed on the second module so that a probability of a win is directly proportional to an amount of performed purchases.

2. A paper element, according to claim 1, wherein said coupling means comprise an adhesive arranged at said first and second longitudinal side edges of the first and second modules, wherein said first and second longitudinal side edges further comprising at least a longitudinal die-cut line.

3. A paper element, according to claim 1, wherein said winning and not winning portions are separated by die-cut horizontal lines and/or glued to one another.

4. A paper element, according to claim 1, wherein said first module has a front surface preprinted as a restaurant invoice.

5. A paper element, according to claim 1, wherein said first module is provided with a rear surface bearing printed marks.

* * * * *